US006613161B2

(12) United States Patent
Zheng et al.

(10) Patent No.: US 6,613,161 B2
(45) Date of Patent: Sep. 2, 2003

(54) PROCESS FOR LASER MARKING METAL SURFACES

(75) Inventors: Hong Yu Zheng, Singapore (SG); Gnian Cher Lim, Singapore (SG)

(73) Assignee: Singapore Institute of Manufacturing Technology, Singapore (SG)

( * ) Notice: Subject to any disclaimer, the term of this patent is extended or adjusted under 35 U.S.C. 154(b) by 0 days.

(21) Appl. No.: 09/799,724

(22) Filed: Mar. 7, 2001

(65) Prior Publication Data

US 2001/0030002 A1 Oct. 18, 2001

(30) Foreign Application Priority Data

Mar. 7, 2000 (SG) ..... 20001597

(51) Int. Cl.[7] ..... C23C 8/00

(52) U.S. Cl. ..... 148/241; 148/276; 148/280; 148/284; 427/596; 427/597

(58) Field of Search ..... 148/241, 276, 148/280, 284; 427/596, 597

(56) References Cited

U.S. PATENT DOCUMENTS

| | | | | |
|---|---|---|---|---|
| 4,434,189 | A | | 2/1984 | Zaplatynsky |
| 4,613,386 | A | * | 9/1986 | Yates et al. ..... 148/241 |
| 4,774,393 | A | | 9/1988 | Tarumoto et al. |
| 4,806,731 | A | | 2/1989 | Bragard et al. |
| 4,945,207 | A | | 7/1990 | Arai |
| 5,373,135 | A | | 12/1994 | Beyer et al. |
| 5,468,932 | A | | 11/1995 | Jacob |
| 5,605,641 | A | | 2/1997 | Chiba et al. |
| 5,801,868 | A | | 9/1998 | Hayasaka et al. |

FOREIGN PATENT DOCUMENTS

| | | | |
|---|---|---|---|
| EP | 0280671 | A2 | 8/1988 |
| EP | 0352326 | A1 | 1/1990 |
| EP | 0 647 720 | A1 | 4/1995 |
| EP | 0729806 | A1 | 9/1996 |
| WO | WO 93/16838 | A2 | 9/1993 |
| WO | WO-94/11146 | A1 * | 5/1994 |

OTHER PUBLICATIONS

ASM International Handbook Committee, "ASM Handbook vol. 5: Surface Engineering", ASM International, Feb. 1996, pp. 144–151.*

* cited by examiner

*Primary Examiner*—John Sheehan
*Assistant Examiner*—Andrew L. Oltmans
(74) *Attorney, Agent, or Firm*—Sughrue Mion, PLLC

(57) ABSTRACT

A method of laser marking which comprises applying a laser beam to a metal surface under the influence of an assist gas to produce durable, repeatable and striking colors on the metal surface. The method provides an easy and flexible alternative to conventional metal decorating techniques.

38 Claims, 2 Drawing Sheets

PROCESS FOR LASER MARKING METAL SURFACES

The present invention relates to a process for laser marking metal surfaces. In particular, the invention relates to a method of laser marking which comprises applying a laser beam to a metal surface under the influence of an assist gas to produce durable, repeatable and striking colours on the metal surface.

BACKGROUND TO THE INVENTION

Metals such as titanium, stainless steel and magnesium are widely used in many areas, such as in the manufacture of recreational and personal items. Such items may include, for example, camera casings, mobile phones, sporting goods, jewellery, watch cases, eye-glass frames, tie-pins, hair pins, souvenirs and so on. The cosmetic appearance of these items or products is of recognised importance to their commercial success. Furthermore, personalisation of such products is becoming increasingly desirable. Laser marking is regarded as a highly flexible process for creating patterns on articles, including metal articles. However, conventional laser marking techniques engrave on metal surfaces to form rough grooves with brown or black burn marks to create the marking contrast. These marks are not generally attractive from the cosmetic view point.

Printing and emulsion coating are also common techniques used for the decoration of metal surfaces. However, scratch and wear resistance of such coatings and the fading of colours of these coatings with time are recognised problems associated with these coatings. Hard coatings, such as of TiN have also been used for protective and decorative applications. Deposition of such hard coatings is generally achieved by flame and plasma spraying, sputtering and vacuum evaporation or the like. However, these coatings often have coarse surfaces and provide poor uniformity. Furthermore, using such techniques multiple steps are required to create coatings of multiple colours. In this regard, inflexibility in changing the applied colours and patterns generally makes these techniques unsuitable for product personalisation.

Decorative coatings on metal surfaces may also be prepared by electrochemical treatments in aqueous electrolytes. Such techniques generally employ certain voltages and electrical currents as described in U.S. Pat. No. 4,869,789. In these processes, changing the metal ions in the electrolyte provides for changes in colours applied to the metal surface. This process has been used in, for example, the jewellery industry, and is more commonly used for the anodising of titanium to create colour coatings. However, flexibility of changing the applied colours and patterning is limited.

SUMMARY OF THE INVENTION

According to one aspect of the present invention, there is provided a process for laser marking a metal surface comprising:

applying a laser of predetermined wavelength and beam energy to said metal surface, said metal surface, during the application of said laser having an assist gas directed thereon at a predetermined gas pressure and flowrate to facilitate controlled oxide film formation on said metal surface where said laser is applied.

The invention also provides metal surfaces including a mark applied by the process described in the immediately preceding paragraph, or a substrate or article including such a metal surface.

BRIEF DESCRIPTION OF THE DRAWINGS

A more detailed description of embodiments of the invention will now be described with reference to the accompanying drawings in which.

DETAILED DESCRIPTION OF THE INVENTION

Figure 2:
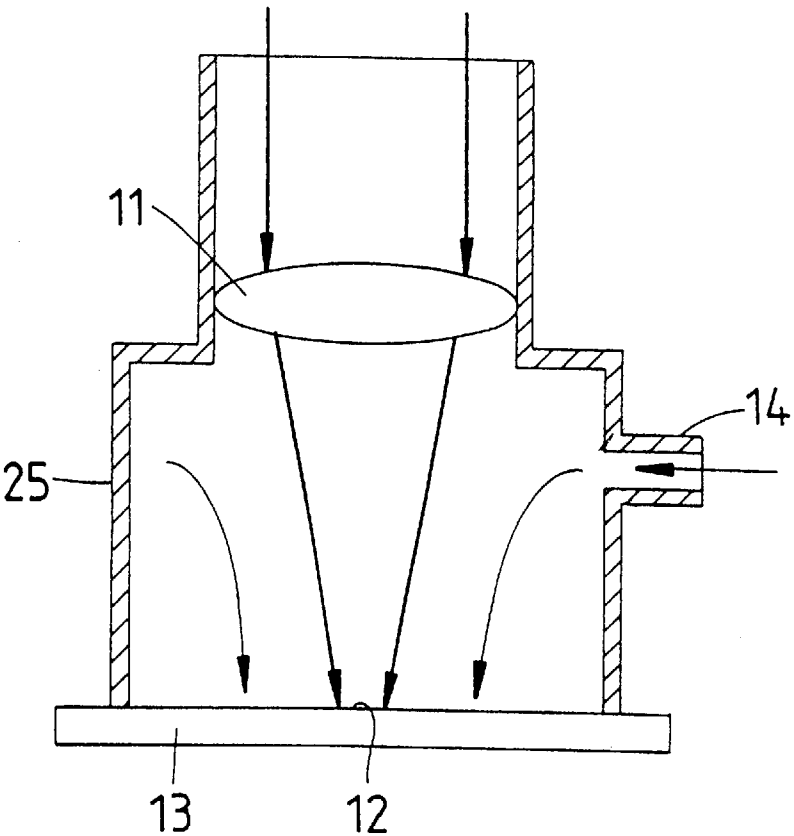
FIG. 2 illustrates the introduction of the assist gas to a substrate by an alternate means.

The present invention advantageously provides a process for laser marking a metal surface to produce flexible, durable, high contrast and multiple-colour patterns. The process employs a laser beam of predetermined wavelength and beam energy, applied to the metal surface under the action of an assist gas to control the formation of oxide films on the metal surface. More particularly, the developed technique uses a laser beam to grow controllable transparent or semi-transparent films on the metal surface using the assist gas as a catalyst for the formation of the films. It has been found that various colours and different tones of these colours may be produced by varying the process parameters and through controlling the thickness of the grown films in relation to the visible wavelengths. When viewed at different angles, the laser generated colour pattern may change its colour from red to brown, purple and blue. It is believed that this effect is a light interference effect. Analysis using an ellipsometer confirms that light interference may be the main cause of the varying colours.

The assist gas directed to the metal surface may be any suitable gas which may be used to facilitate the controlled formation of an oxide film. In a preferred embodiment, the assist gas is selected from the group consisting of argon, air, helium, oxygen and nitrogen. It has been found that processing under an $O_2$ atmosphere, that is on the application of an $O_2$ assist gas, good colouring is achievable at lower laser dosages as the $O_2$ promotes the formation of oxide films. The thickness of the oxide film formed will determine the interference colour. More particularly, using $O_2$ as the assist gas, a blue colouration may be achieved while using air under the same processing parameters may form a brown colouration. Moreover, using $O_2$ as the assist gas, it has been found that the number of laser pulses needed to achieve a particular result is about half that required to achieve the same result using air as the assist gas. On the other hand, other gases such as nitrogen, helium and argon may be used to control the oxidation process by reducing the $O_2$ content in the atmosphere at the metal surface. In this case, the oxidation process will be slowed down enabling a finer control of the growth of the oxide film. As a result, more colour shades may be made available.

The gas may be applied to the metal surface by any suitable means, as will be described hereafter in more detail, but is advantageously directed to the surface in a continuous manner, for example, via a nozzle or as a laminar flow across the surface of the metal substrate to which the beam is being applied.

The gas pressure and flow rate of the assist gas may be selected to ensure that the film formation according to the invention on the metal surface is facilitated. Preferably, the assist gas is supplied to the metal surface at a pressure of from 0.5 to 3 bar and at a flow rate of from 50 to 100 l/min.

The laser applied to the metal surface may include any conventional laser, provided that film formation on the metal surface is facilitated by the action of the laser under the influence of the assist gas. Preferably, the laser is a UV or visible laser, more preferably the laser is selected from the group consisting of a KrF excimer laser of wavelength 248 nm, a $4^{th}$ harmonic YAG laser of wavelength 266 nm, an XeCl excimer laser of wavelength 308 nm, an XeF excimer laser of wavelength 351 nm, a $3^{rd}$ harmonic Nd:YAG laser of wavelength 355 nm, a $2^{nd}$ harmonic Nd:YAG laser of wavelength 532 nm and argon-ion lasers with their harmonic wavelengths. Furthermore, the laser may be applied to the surface of the metal in either continuous wave or pulse mode. In a preferred embodiment, the laser beam profile of the laser beam is a top hat flat beam. Other beam modes, such as TEM 00 and TEM 01 may also be used. Gaussian beams are also considered appropriate for use in the process of the invention. A conventional laser beam, such as described by the prior art, has a near Gaussian beam, and so the beam energy distribution is non-uniform (different within the same beam spot). This will create different colours within the same beam spot. The heat-affected-zone (HAZ) will generally show different colours as well. When a large pattern is achieved by the dot matrix technique, the HAZ of the spot and the non-uniformity of the beam affect the overall colour effect and the resolution of the colour image. A Q-switched solid-state YAG laser as described in the prior art has much wider HAZ and therefore lower resolution of a marked-image. Longer wavelength (e.g. infrared laser of a Q-switched YAG) as used in the prior art may also lead to surface damage including grooves due to material removal or changing the surface structures of the original surface as already discussed. The lasers employed in the present invention are advantageously selected to produce no damage to the original surface.

It has been found that using a Q-switched CW solid-slate YAG laser at a wavelength of from 532 nm to 1060 nm at various levels of power density, speeds, beam overlaps etc, the colour spectrum and shades of colours are not as wide as those achieved using UV lasers. For example, green colouration cannot be achieved. The beam is selected to minimise the thermal effect caused by the laser beam.

As herebefore stated, the laser may be applied to the metal surface in either continuous wave or pulse mode. If applied in pulse mode, the laser pulse duration affects the oxidation process at the metal surface given that it determines the peak power of the laser beam. Preferably, the pulse duration is from about 1–100 ns, more preferably about 1–30 ns.

The process of laser marking according to the invention may be used to mark the surfaces of a number of metals without particular limitation. However, particular interest is given to the marking of the transition metals and stainless steel given their common usage in the areas envisaged to be of particular relevance to the present laser marking process. A preferred but non-exhaustive list of suitable metals includes stainless steel, Ti, Sc, Cr, Mn, V, Fe, Ni, Co, Cu, Zn, Zr, Nb, Y, Tc, Ag, Cd, Pd, Ta, Pt, Au, Al, Hf, Mo, W and Mg.

It has been found that surface brightness, texture and roughness of the metal surface to which the laser is applied play an important part in determining the colour spectrum, brightness and uniformity produced on the application of the laser under the process according to the invention. As such, in a preferred embodiment, the process additionally includes pretreating the metal surface prior to application of the laser thereto. The pretreatment of the surface may be selected as desired and may include, for example, wet blasting, mechanical and chemical polishing or the like. Generally, highly polished surfaces will provide for a wider range of colours and brighter colours than would a dull surface. For example, if all other parameters remain constant, it has been found that a mirror finish titanium plate (shiny with an Ra value of 0.0253 micrometer) is marked, a wide range of colours and bright colours can be achieved. If a sandblast surface which is relatively dull (Ra value of 0.6 microns) is marked, only a few dull colours can be achieved, generally dull grey and brown. As such, the pretreatment preferably provides the metal surface with a smooth, uniform and bright finish. More preferably, the pretreatment provides the surface with an Ra value of less than 0.5 micron, even more preferably with an Ra value of less than 0.1 micron.

The laser is advantageously applied to the metal surface in a predetermined manner to create a desired colour or colours as the marking on the metal surface. More particularly, the laser may be applied in the process of the present invention to form a pattern on the metal surface. In this regard, the manner in which the laser is applied to create the desired colour or colours includes any one of varying the number of laser pulses for a given laser beam power density or pulse energy density, varying the distance between laser beam spots, varying the beam energy density or power density, marking already marked areas and varying laser beam scanning speed or substrate moving speed. A pattern may be achieved by, for example, any one of synchronizing movement of a mask having the desired pattern with the movement of a metal surface, scanning the laser beam onto the metal surface using computer control and controlling substrate movement relative to the laser beam while the beam is kept stationary. Resolution of the markings applied to the metal surface may be altered by various means including varying the laser beam size, adjusting spacing between beam spots, shaping the laser beam profile and employing the use of masks.

It has also been found that when the process is performed at elevated temperature, that is on a heated metal surface, colours were produced at a much faster rate compared with those formed conducting the process at room temperature. It is believed that this may be as a result of the intensification of the oxidation process at the elevated temperature. At elevated temperatures the formed colours appear more opaque or metallic and are higher in contrast than those formed at room temperature. AS such, the process is advantageously conducted at an elevated temperature of above about 350 C. It is further envisaged that alternating the temperature of the metal substrate during application of the laser may be a further means by which variation in the colours applied may be achieved.

Figure 1:
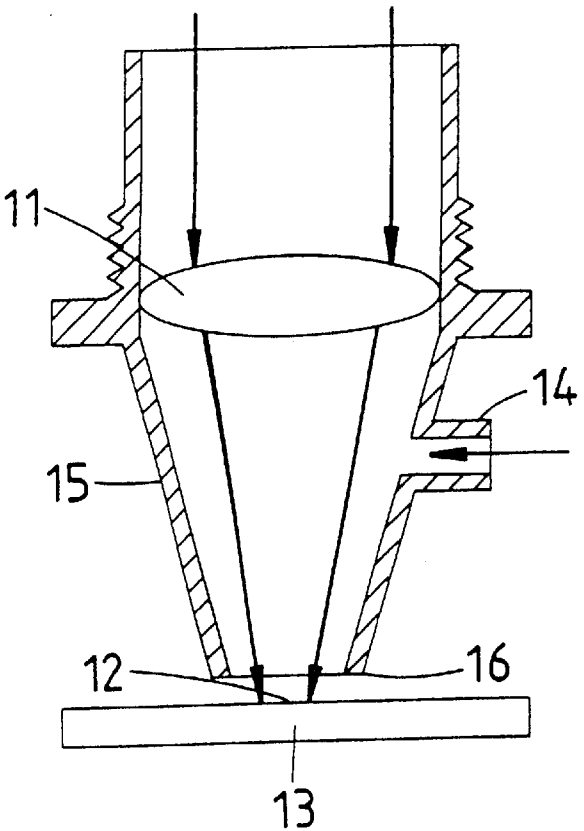
FIG. 1 illustrates the introduction of an assist gas to a substrate via a nozzle.

Referring to the drawings, FIG. 1 illustrates the application of an assist gas to a substrate 13 to which a laser beam is being applied through a lens 11. The assist gas is in this case introduced to the surface 12 of the substrate 13 through an inlet 14 of a nozzle 15. The assist gas passes through the inlet 14 into the chamber of the nozzle 15 and out through the nozzle outlet 16 directly to the surface 12 of the substrate 13 to which the laser is being applied. According to this embodiment, the direct application of the assist gas to the point of application of the laser beam is provided for by the nozzle 15.

FIG. 2 illustrates a similar situation as that illustrated in FIG. 1 insofar as an assist gas is introduced via an inlet 14 to the surface 12 of the substrate 13 to which the laser beam is being applied. However, in this case, rather than a nozzle, there is provided a cylindrical chamber 25 which is applied to the surface 12 of the substrate 13. This ensures that the atmosphere within the chamber, and therefore the atmosphere at the surface 12 to which the laser beam is being applied, is provided with a steady flow of the assist gas.

Figure 3:
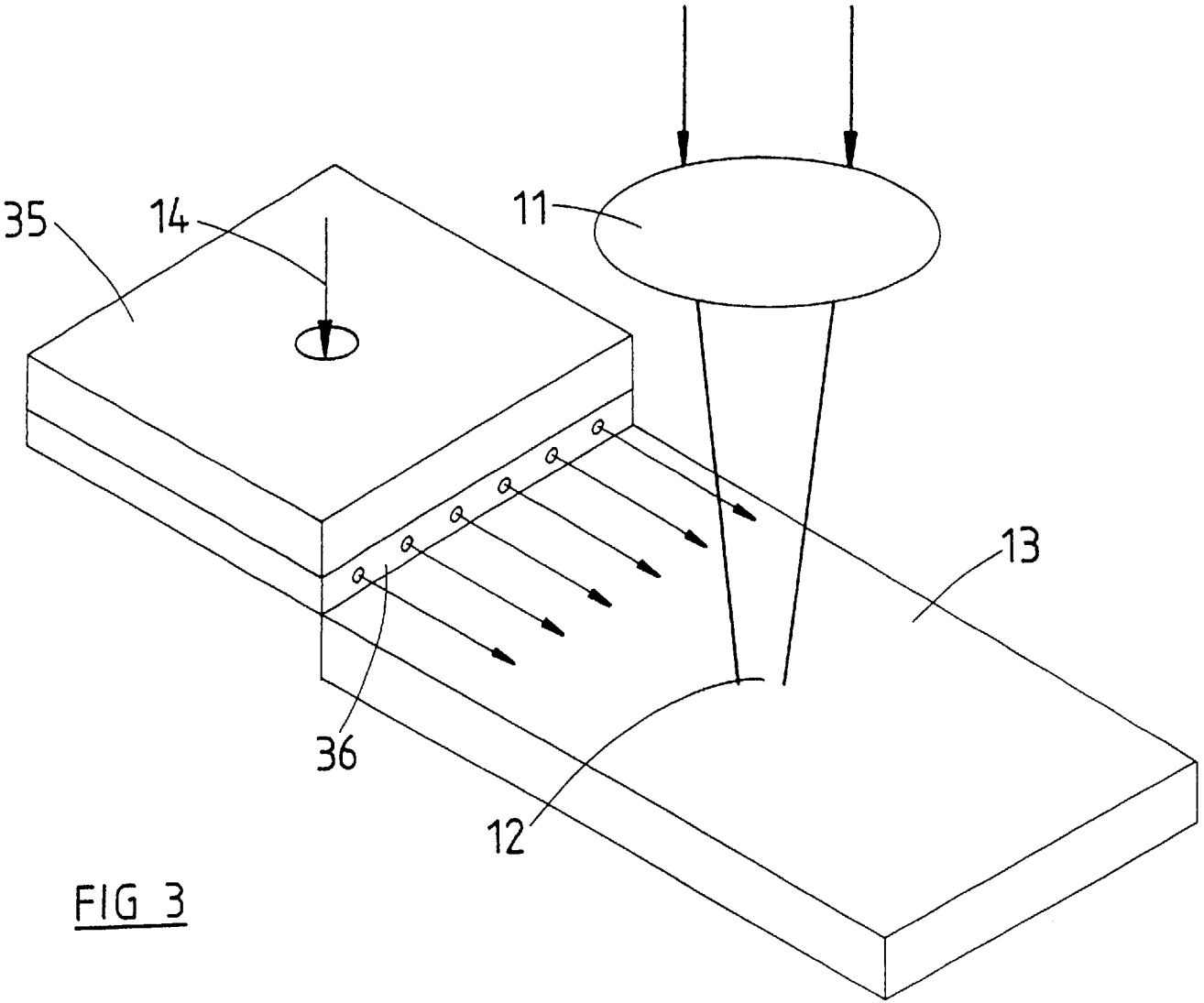
FIG. 3 illustrates the introduction of the assist gas to a substrate as a laminar flow.

In a further alternate embodiment, the assist gas may be introduced via an inlet 14 of a box 35 which is positioned adjacent the substrate 13 as shown in FIG. 3. The assist gas having been passed into the box 35 exits via outlets 36, which may include a plurality of outlets as shown in the Figure or which may alternatively include a slit which extends along the side of the box 35 adjacent the substrate 13. The assist gas having passed through the outlets 36 forms a laminar flow across the surface 12 of the substrate 13 to which the laser beam is being applied. This configuration advantageously ensures that the atmosphere at the surface 12 of the substrate 13 at the point of application of the laser beam is provided with a constant laminar flow of the assist gas.

Reference will now be made to a number of examples to further exemplify preferred embodiments of the invention. However, it should be recognised that the examples are provided for illustrative purposes only and should not be construed as limiting on the invention in any way.

EXAMPLE 1

Parameters for Laser-produced Yellow on Titanium (Polished Using a Sand Paper, Grade p600)
Laser wavelength: 248 nm
Beam pulse energy: 260 mJ
Assist gas O2: 1 bar
Beam overlaps: 12
Beam energy density: 1 J/cm$^2$

EXAMPLE 2

Parameters for Laser-produced Brown on Titanium (Polished Using a Sand Paper, Grade p600)
Laser wavelength: 248 nm
Beam pulse energy: 260 mJ
Assist gas O2: 1 bar
Beam overlaps: 14
Beam energy density: 1 J/cm$^2$

EXAMPLE 3

Parameters for Laser-produced Purple on Titanium (Polished Using a Sand Paper, Grade p600)
Laser wavelength: 248 nm
Beam pulse energy: 260 mJ
Assist gas O2: 1 bar
Beam overlaps: 18
Beam energy density: 1 J/cm$^2$

EXAMPLE 4

Parameters for Laser-produced Dark Blue on Titanium (Polished Using a Sand Paper, Grade p600)
Laser wavelength: 248 nm
Beam pulse energy: 260 mJ
Assist gas O2: 1 bar
Beam overlaps: 20
Beam energy density: 1 J/cm$^2$

EXAMPLE 5

Parameters for Laser-produced Sky Blue on Titanium (Polished Using a Sand Paper, Grade p600)
Laser wavelength: 248 nm
Beam pulse energy: 260 mJ
Assist gas O2: 1 bar
Beam overlaps: 22
Beam energy density: 1 J/cm$^2$

EXAMPLE 6

Parameters for Laser-produced Dark Green on Titanium (Polished Using a Sand Paper, Grade p600)
Laser wavelength: 248 nm
Beam pulse energy: 260 mJ
Assist gas O2: 1 bar
Beam overlaps: 24
Beam energy density: 1 J/cm$^2$

EXAMPLE 7

Parameters for Laser-produced Apple Green on Titanium (Polished Using a Sand Paper, Grade p600)
Laser wavelength: 248 nm
Beam pulse energy: 260 mJ
Assist gas O2: 1 bar
Beam overlaps: 26
Beam energy density: 1 J/cm$^2$

EXAMPLE 8

Parameters for Laser-produced Yellow Green on Titanium (Polished Using a Sand Paper, Grade p600)
Laser wavelength: 248 nm
Beam pulse energy: 260 mJ
Assist gas O2: 1 bar
Beam overlaps: 28
Beam energy density: 1 J/cm$^2$

EXAMPLE 9

Parameters for Laser-produced Pink on Titanium (Polished Using a Sand Paper, Grade p600)
Laser wavelength: 248 nm
Beam pulse energy: 260 mJ
Assist gas O2: 1 bar
Beam overlaps: 36
Beam energy density: 1 J/cm$^2$

EXAMPLE 10

Parameters for Laser-produced Grey on Titanium (Polished Using a Sand Paper, Grade p600)
Laser wavelength: 248 nm
Beam pulse energy: 260 mJ
Assist gas O2: 1 bar
Beam overlaps: 40
Beam energy density: 1 J/cm$^2$

EXAMPLE 11

Parameters for Laser-produced Yellow on Stainless Steel (Wet Blasted Matt Surface)
Laser wavelength: 248 nm
Beam pulse energy: 260 mJ
Assist gas O2: 1 bar
Beam overlaps: 16
Beam energy density: 1 J/cm$^2$

EXAMPLE 12

Parameters for Laser-produced Brown on Stainless Steel (Wet Blasted Matt Surface)
Laser wavelength: 248 nm
Beam pulse energy: 260 mJ
Assist gas O2: 1 bar
Beam overlaps: 20
Beam energy density: 1 J/cm$^2$

EXAMPLE 13

Parameters for Laser-produced Purple Blue on Stainless Steel (Wet Blasted Matt Surface)
Laser wavelength: 248 nm
Beam pulse energy: 260 mJ Assist gas O2: 1 bar
Beam overlaps: 24
Beam energy density: 1 J/cm$^2$

EXAMPLE 14

Parameters for Laser-produced Blue on Stainless Steel (Wet Blasted Matt Surface)
Laser wavelength: 248 nm
Beam pulse energy: 260 mJ
Assist gas O2: 1 bar
Beam overlaps: 28
Beam energy density: 1 J/cm$^2$

EXAMPLE 15

Parameters for Laser-produced Blue Green on Stainless Steel (Wet Blasted Matt Surface)
Laser wavelength: 248 nm
Beam pulse energy: 260 mJ
Assist gas O2: 1 bar
Beam overlaps: 32
Beam energy density: 1 J/cm$^2$

EXAMPLE 15

Parameters for Laser-produced Yellow Green on Stainless Steel (Wet Blasted Matt Surface)
Laser wavelength: 248 nm
Beam pulse energy: 260 mJ
Assist gas O2: 1 bar
Beam energy density: 1 J/cm$^2$
Beam overlaps: 36

The present invention advantageously provides a means by which laser marking of a metal surface may be achieved to produce consistently high contrast, multiple colour, durable and decorative patterns. Advantageously the process of the invention provides an easier and more flexible means of decorating metal products than conventional methods, including anodizing and coating techniques. Furthermore, it has been found that markings applied using the process of the invention may advantageously remain unchanged after various environmental testing conditions, such as soaking in strong acids including sulphuric, phosphoric and nitric acids, and soaking in other aggressive environments. Still further, the markings applied by the process of the present invention are resistant to fading on the application of solvents such as acetone, petrol, washing liquid or powder, trichloroethene, propanone, turpentine and alcohol.

Those skilled in the art will appreciate that the invention described herein is susceptible to variations and modifications other than those specifically described. It is to be understood that the invention includes all such variations and modifications. The invention also includes all of the steps, features, compositions and compounds referred to or indicated in this specification, individually or collectively, and any and all combinations of any two or more of said steps or features.

What is claimed is:

1. A process for laser marking a bare metal surface comprising:

applying a laser of predetermined wavelength and beam energy to said bare metal surface to form a pattern, said bare metal surface, during the application of said laser, having an assist gas directed thereon at a predetermined gas pressure and flowrate to facilitate controlled oxide film formation on said bare metal surface where said laser is applied.

2. A process according to claim 1, wherein said assist gas is selected from the group consisting of helium, argon, air, $O_2$ and $N_2$.

3. A process according to claim 1, wherein said assist gas is supplied to the bare metal surface at a pressure of from 0.5 to 3 bar and at a flowrate of from 50 to 100 l/min.

4. A process according to claim 1, wherein said laser is a UV or visible laser.

5. A process according to claim 1, wherein said laser comprises one of a KrF excimer laser, a 4$^{th}$ harmonic YAG laser, an XeCl excimer laser, an Xef excimer laser, a 3$^{rd}$ harmonic Nd:YAG laser, a 2$^{nd}$ harmonic Nd:YAG laser and argon-ion lasers.

6. A process according to claim 1, wherein said laser is applied to said surface in either continuous wave or pulse mode.

7. A process according to claim 6, wherein said laser is applied in pulse mode with a pulse duration of from about 1 to 100 ns.

8. A process according to claim 7, wherein the pulse duration is from about 1 to 30 ns.

9. A process according to claim 1, wherein the laser beam profile of said laser beam is a top-hat flat beam or a Gaussian beam.

10. A process according to claim 1, wherein said bare metal surface is of a metal selected from the group consisting of stainless steel, Ti, Sc, Cr, Mn, V, Fe, Ni, Co, Cu, Zn, Zr, Nb, Y, Tc, Ag, Cd, Pd, Ta, Pt, Au, Al, Hf, Mo, W and Mg.

11. A process according to claim 1, including pretreating the metal surface prior to application of said laser thereto.

12. A process for laser marking a bare metal surface comprising:

treating a bare metal surface by wet blasting, mechanical or chemical polishing; and then as the next step applying a laser of predetermined wavelength and beam energy to the treated bare metal surface to form a pattern, the treated bare metal surface, during the application of said laser, having an assist gas directed thereon at a predetermined gas pressure and flowrate to facilitate controlled oxide film formation on said bare metal surface where said laser is applied.

13. A process according to claim 11, wherein said pretreatment provides said surface with a smooth, uniform and bright finish.

14. A process according to claim 13, wherein following said pretreatment said surface has an Ra value of less than 0.5 microns and said laser application is performed on the pretreated surface.

15. A process according to claim 13, wherein following said pretreatment said surface has an Ra value of less than 0.1 microns and said laser application is performed on the pretreated surface.

16. A process according to claim 1, wherein said laser is applied to the bare metal surface in a predetermined manner to create a desired colour or colours as the marking on the metal surface.

17. A process according to claim 16, wherein the manner in which the laser is applied to create said desired colour or colours includes any one of varying the number of laser pulses for a given laser beam power density or pulse energy density, varying the distance between laser beam spots, varying the beam energy density or power density, marking already marked areas and varying laser beam scanning speed or substrate moving speed.

18. A process according to claim 1, wherein said marking of said bare metal surface includes applying a desired pattern to said surface, said pattern being achieved by any one of synchronising movement of a mask having the desired pattern which the movement of the metal surface, scanning the laser beam onto the metal surface using computer control and controlling substrate movement relative to the laser beam while the beam is kept stationary.

19. A process according to claim 1, wherein said laser is applied to said bare metal surface at an elevated temperature.

20. A process according to claim 19, wherein said laser is applied wherein said bare metal surface is at a temperature of above about 350° C.

21. A method of forming a color pattern on a metal surface comprising the steps of:

applying a laser of a predetermined wavelength and beam energy to said metal surface; and simultaneously directing an assist gas to said metal surface, to form a color pattern on said metal surface, wherein said color pattern is controlled by controlling the number of beam overlaps at locations on said metal surface.

22. The method of forming a color pattern on a metal surface as claimed in claim 21, wherein said color pattern is yellow.

23. The method of forming a color pattern on a metal surface as claimed in claim 21, wherein said color pattern is brown.

24. The method of forming a color pattern on a metal surface as claimed in claim 21, wherein said color pattern is blue-green.

25. The method of forming a color pattern on a metal surface as claimed in claim 21, wherein said color pattern is purple.

26. The method of forming a color pattern on a metal surface as claimed in claim 21, wherein said color pattern is dark blue.

27. The method of forming a color pattern on a metal surface as claimed in claim 21, wherein said color pattern is dark green.

28. The method of forming a color pattern on a metal surface as claimed in claim 21, wherein said color pattern is apple green.

29. The method of forming a color pattern on a metal surface as claimed in claim 21, wherein said color pattern is yellow green.

30. The method of forming a color pattern on a metal surface as claimed in claim 21, wherein said color pattern is pink.

31. The method of forming a color pattern on a metal surface as claimed in claim 21, wherein said color pattern is grey.

32. The method of forming a color pattern on a metal surface as claimed in claim 21, wherein said color pattern is purple blue.

33. The method of forming a color pattern on a metal surface as claimed in claim 21, wherein said color pattern is blue.

34. A method of coloring a metal surface via controlled oxidation thereof, comprising:

applying a laser of predetermined wavelength and beam energy to said metal surface in the presence of an assist gas which facilitates controlled formation of an oxide of said metal to form a pattern.

35. The method of forming a color pattern on a metal surface as claimed in claim 34, wherein said color pattern is sky blue.

36. A method of variably controlling the formation of an oxide film on a metal surface, comprising:

applying a laser of a predetermined wavelength and controlled beam energy to said metal surface;

simultaneously applying an assist gas at least at the location at which said laser is incident upon said metal surface;

thereby variably controlling the rate of oxidation of said metal surface to form a pattern.

37. A method of forming a metal oxide coating exhibiting an interference effect when exposed to light, comprising:

applying a laser of predetermined wavelength and beam energy to said metal surface;

simultaneously applying an assist gas to said metal surface; and controlling the thickness of a film formed through oxidation of said metal surface, to thereby form a metal oxide coating exhibiting an interference effect when exposed to light.

38. A method of variably coloring a metal surface via controlled oxidation thereof, comprising:

applying a laser of a predetermined wavelength to said metal surface in the presence of an assist gas; and controlling the color of a film composed of the oxide of said metal to form a pattern by varying at least one of:

a) the number of laser pulses for a given laser beam power density or pulse energy density;

b) the distance between incident laser beam spots;

c) the beam energy density or power density;

d) the number of times said laser is applied to a given location; and e) a scanning speed of said laser or a moving speed of said metal surface.

* * * * *